US009540156B1

(12) United States Patent
Kim et al.

(10) Patent No.: US 9,540,156 B1
(45) Date of Patent: Jan. 10, 2017

(54) LOCK ASSEMBLY FOR BAG

(71) Applicant: YujinKreves, Ltd., Seoul (KR)

(72) Inventors: Jong-yong Kim, Cheonan-si (KR); Young-yeon Kim, Incheon (KR); Kee-bong Nam, Changwon-si (KR); Myung-soo Kim, Seoul (KR)

(73) Assignee: YUJINKREVES, LTD. (KR)

( * ) Notice: Subject to any disclaimer, the term of this patent is extended or adjusted under 35 U.S.C. 154(b) by 0 days.

(21) Appl. No.: 15/140,764

(22) Filed: Apr. 28, 2016

(30) Foreign Application Priority Data

Feb. 29, 2016 (KR) ..... 10-2016-0024641

(51) Int. Cl.
*B65D 33/24* (2006.01)
*B65D 55/02* (2006.01)
*A45C 1/02* (2006.01)

(52) U.S. Cl.
CPC ..... *B65D 55/02* (2013.01); *A45C 1/02* (2013.01); *B65D 33/24* (2013.01)

(58) Field of Classification Search
CPC ..... E05C 3/041; E05B 65/5253
USPC ..... 383/86.2; 292/44, 45, 47, 53, 54, 194, 292/195, 280, DIG. 48, DIG. 50; 150/119
See application file for complete search history.

(56) References Cited

U.S. PATENT DOCUMENTS 4,893,851 A * 1/1990 Murai ..... E05C 3/04 292/204
4,932,691 A * 6/1990 White ..... E05B 53/003 292/336.3

* cited by examiner

*Primary Examiner* — Jes F Pascua
(74) *Attorney, Agent, or Firm* — Park & Associates IP Law, P. C.

(57) ABSTRACT

The present disclosure provides a lock assembly for a bag, wherein the bag has a bag body and a bag flap, the assembly comprising: a body-side sub-assembly secured to the bag body; and a flap-side sub-assembly secured to the bag flap, wherein the body-side sub-assembly comprises: a base member having a rear portion secured to the bag body, a pair of rotation members, each rotation member including an upper grip and a lower shaft extending from the upper grip, a rotation-force transfer mechanism configured to transfer a rotation force between the pair of rotation members, wherein the rotation-force transfer mechanism employs a belt.

3 Claims, 6 Drawing Sheets

LOCK ASSEMBLY FOR BAG

REFERENCE TO RELATED APPLICATIONS

This application claims the priority benefit of Korean Patent Application No. 10-2016-0024641 filed on Feb. 29, 2016, the entire contents of which are incorporated herein by reference for all purposes as if fully set forth herein.

FIELD OF THE INVENTION

The present disclosure relates to a lock assembly for a bag, and, more particularly, to a lock assembly for a bag, wherein the lock assembly is attached to a bag body and a bag flap and is configured to fasten or unfasten the flap to or from the body.

BACKGROUND OF THE INVENTION

One example of a portable bag to receive therein a relatively small article is shown in FIG. 1. As shown in FIG. 1, a bag, in particular, a handbag 200 includes a bag body 210 having a storage space formed therein, and a bag flap 220 configured to open or close an opening of the body 210. The handbag 200 include a lock assembly 10 attached to the body and flap. When the bag flap 220 closes the opening of the bag body 210, the lock assembly 10 keeps a locking state of the bag.

The lock assembly 10 includes a body-side sub-assembly 20 secured to the bag body 210 and a flap-side sub-assembly 30 secured to the bag flap 220. In an operation, for a lock mode, the body-side sub-assembly 20 is coupled to the flap-side sub-assembly 30 and is rotated to a locking position. Otherwise, for an unlock mode, the body-side sub-assembly 20 is rotated to an unlocking position and is separated from the flap-side sub-assembly 30. This may be referred to a "turn-lock" mechanism. With this turn-lock mechanism, the body-side sub-assembly 20 may have two rotation members which are gripped by and rotated by a hand of the user such that the body-side sub-assembly 20 is locked into or unlocked from the flap-side sub-assembly 30. Especially, a rotation of only one rotation member may cause a rotation of the other rotation member. This may lead to improved convenience for the user.

As shown in FIG. 2, the body-side sub-assembly 20 may include a base member 21, a pair of rotation members 24 and a rotation-force transfer mechanism 25. The body-side sub-assembly 20 may be secured to the bag body 210 using a bag body fixture 22 and bag body fixing bolts 23.

The base member 21 may be secured to the bag body 210 using the bag body fixture 22 and bag body fixing bolts 23. Thus, the base member 21 may be closed, at an open rear side thereof, to form an inner space therein.

On a front side of the base member 21, a pair of shaft-insertion holes 21*a* may be formed to correspond to a pair of elongate holes 31*a* of the flap-side sub-assembly 120 respectively. Each of the shaft-insertion holes 21*a* may have a guide groove 21*b* formed vertically along the hole 21*a* at one side thereof.

The pair of rotation members 24 each may include a horizontal bar-shaped upper grip 24*a* and a vertical bar-shaped lower shaft 24*b*. The horizontal bar-shaped upper grip 24*a* and the vertical bar-shaped lower shaft 24*b* may be monolithic. A combination of the horizontal bar-shaped upper grip 24*a* and the vertical bar-shaped lower shaft 24*b* is rotated to lock or unlock the bag.

The upper grip 24*a* may pass away the corresponding elongate hole 31*a*, and, thereafter, may be kept to be orientated in an orthogonal direction to the elongate hole 31*a* to keep the locking state of the bag. Otherwise, the upper grip 24*a* may be orientated in a parallel direction to the corresponding elongate hole 31*a* and, thereafter, may pass away the corresponding elongate hole to be separated from the elongate hole 31*a*, to unlock the bag. The upper grip 24*a* may be disposed on the front side of the base member 21.

The lower shaft 24*b* may extend downwards vertically from the corresponding upper grip 24*a*. The lower shaft 24*b* is rotatably inserted into the shaft-insertion hole 21*a* via a rotation of the upper grip 24*a*. That is, the lower shaft 24*b* is rotatably engaged with the base member 21.

The lower shaft 24*b* may have a rotation guide protrusion 24*c* formed thereon, where the rotation guide protrusion 24*c* is configured to guide the rotation member 24 along the guide groove 21*b* during the vertical movement and rotation of the rotation member 24. To be specific, the rotation guide protrusion 24*c* is configured to guide the rotation member 24 to move from a top portion of the guide groove 21*b* to a middle level portion to a bottom portion of the guide groove 21*b* while the rotation member 24 rotates by 90°.

The rotation-force transfer mechanism 25 may include a pair of upper plates, a pair of lower plates, two pairs of balls, two pairs of springs, and a pair of linkers, all of which are disposed in the inner space of the base member 21. The rotation-force transfer mechanism 25 may be operatively coupled to the two lower shafts 24*b*. Thus, when one rotation member of the pair of rotation members 24 is rotated, the rotation-force transfer mechanism 25 may transfer the rotation force from one rotation member to the other rotation member. In this way, the pair of rotation members 24 may be rotated via a rotation of only a single rotation member 24.

The base member fixture 26 closes the open bottom of the base member 21, and the body-side sub-assembly 20 may be secured to the bag body 210 using the base member fixing bolts 27.

As shown in FIG. 3, the flap-side sub-assembly 30 may include a front fixture 31, a rear fixture 32, and fixing bolts 33. The flap-side sub-assembly 30 may be secured to the bag flap 220 using the front fixture 31, rear fixture 32, and fixing bolts 33.

The front fixture 31 may have the adjacent two elongate holes 31*a* formed therein, where the two elongate holes 31*a* pass through the bag flap 220. The front fixture 31 may be secured to a front side of the bag flap 220.

The rear fixture 32 may be secured to a rear side of the bag flap 220 to correspond to the front fixture 31.

The fixing bolt 33 may secure the front fixture 31 and rear fixture 32 to each other, and, thus, fasten the front fixture 31 and rear fixture 32 to the bag flap 220.

FIG. 4 shows a combination of the body-side sub-assembly 20 and flap-side sub-assembly 30 in the conventional lock assembly 10 for a bag. In this connection, as shown in FIG. 4, the bag flap 220 is disengaged from the bag body 210.

For the disengaged state, the upper grip 24*a* of the body-side sub-assembly 20 may be rotated to be oriented in a parallel direction with an extension direction of the corresponding elongate hole 31*a*. Thereafter, the upper grip 24*a* of the body-side sub-assembly 20 may be rotated such that the protrusion 24*c* reaches the middle level of the guide groove 21*b* and, thus, the upper grip 24*a* passes away the corresponding elongate hole 31*a*. In this way, the bag flap 220 may be detached, at its free end, from the bag body 210.

Based on a desired state, namely, a locked or unlocked state of the bag, any one of the two upper grips 24*a* may be rotated by 90° in a clockwise or counter-clockwise direction, vertically upwardly or downwardly, while the guide protrusion 24*c* moves along the guide groove 21*b*. In this connection, the rotation-force transfer mechanism 25 may transfer the rotation force from one rotation member to the other rotation member.

In this connection, the rotation-force transfer mechanism 25 includes the four springs and balls, the two upper plates, the two lower plates, and the two linkers. Thus, the rotation-force transfer mechanism 25 has a large number of the parts thereof. In particular, the balls and springs each has a small size, leading to a difficulty to assemble them. For the locking or unlocking operation of the bag, the rotation direction of the rotation member is limited to the specific direction since the guide groove 21*b* is formed only at one side of the shaft-insertion hole 21*a* and, thus, the rotation guide protrusion 24*c* of the rotation member moves only along the guide groove 21*b*. This may result in inconvenience for the user to lock or unlock the bag. Further, in the conventional lock assembly 10 for a bag, the rotation member 24 is not securely kept to be in the locked or unlocked state of the bag. Further, in the conventional lock assembly 10 for a bag, due to much deviation in movement of the linker, the rotation member 24 is not precisely aligned.

This "Background" section is provided for background information only. The statements in this "Background" section are not an admission that the subject matter disclosed in this "Background" section constitutes prior art to the present disclosure, and no part of this "Background" section may be used as an admission that any part of this application, including this "Background" section, constitutes prior art to the present disclosure.

SUMMARY OF THE INVENTION

Considering the above need, the present disclosure provides a lock assembly for a bag, wherein, for the locking or unlocking operation of the bag, the rotation direction of the rotation member is not limited but includes all directions, leading to convenience for the user to lock or unlock the bag; and a rotation member is precisely aligned; a rotation member is securely kept to be in the locked or unlocked state of the bag; and a rotation-force transfer mechanism has smaller numbers of parts thereof, and the parts each has a large size, leading to easiness to assemble them, and a simple structure, and, thus, a reduced manufacturing cost and an improved product quality.

One aspect of the present disclosure provides a lock assembly for a bag, wherein the bag has a bag body having an article receiving space formed therein, and a bag flap configured to open or close an opening of the body, the assembly comprising:

a body-side sub-assembly secured to the bag body; and a flap-side sub-assembly secured to the bag flap, wherein the flap-side sub-assembly has two elongate holes formed therein, the two elongate holes passing through the bag flap, wherein the body-side sub-assembly comprises:

a base member having a rear portion secured to the bag body, the base member having an inner space formed therein, the base member having two shaft-insertion holes formed in a front portion thereof, the shaft-insertion holes corresponding, in a position, to the two elongate holes respectively;

a pair of rotation members, each rotation member including an upper grip and a lower shaft extending from the upper grip, wherein the upper grip is rotatably disposed on the front portion of the base member, wherein the upper grip is configured to rotate to be oriented to be parallel or orthogonal to an extension direction of the corresponding elongate hole, wherein the upper grip is configured to pass away the corresponding elongate hole, wherein the lower shaft is rotatably inserted into the corresponding shaft-insertion hole; and a rotation-force transfer mechanism configured to transfer a rotation force between the pair of rotation members, the rotation-force transfer mechanism including a pair of rotation-member couplers, and a belt, wherein the pair of rotation-member couplers and the belt are received in the inner space of the base member, wherein each rotation-member coupler is operatively coupled to each lower shaft such that each rotation-member coupler rotates together with each rotation member, wherein the belt is operatively coupled to the two rotation-member coupler to allow the two rotation-member couplers to co-rotate in any direction, wherein each of the shaft-insertion holes has four recesses arranged regularly along a rim of the hole by a 90° angular distance, wherein each rotation member has four convex portions to correspond, in a position, to the four recesses respectively, wherein each convex portion is engaged or disengaged with each recess during the rotation of the rotation member.

In one embodiment, each rotation-member coupler has first teeth formed at an outer periphery thereof, and the belt has second teeth formed at an inner periphery thereof, wherein the first teeth mesh with the second teeth to transfer the rotation force between the two rotation members.

In one embodiment, each spring is provided beneath each rotation-member coupler to keep the engagement or disengagement between each recess and each convex portion.

BRIEF DESCRIPTION OF THE DRAWINGS

A brief description of each drawing is provided to more fully understand the drawings, which is incorporated in the detailed description of the disclosure.

Figure 1:
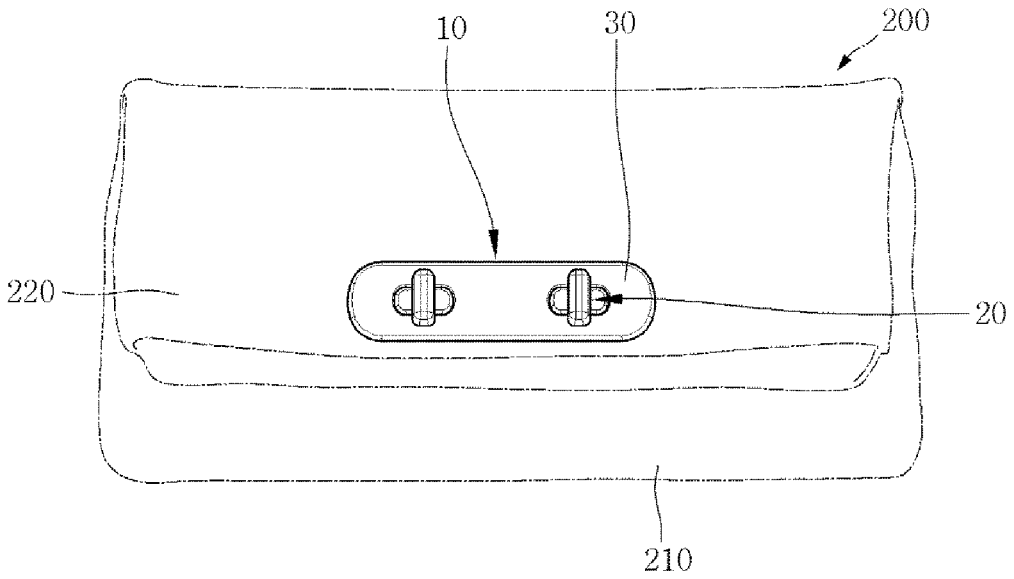
FIG. 1 shows a perspective view of a hand bag having a lock assembly attached thereto.
Figure 2:
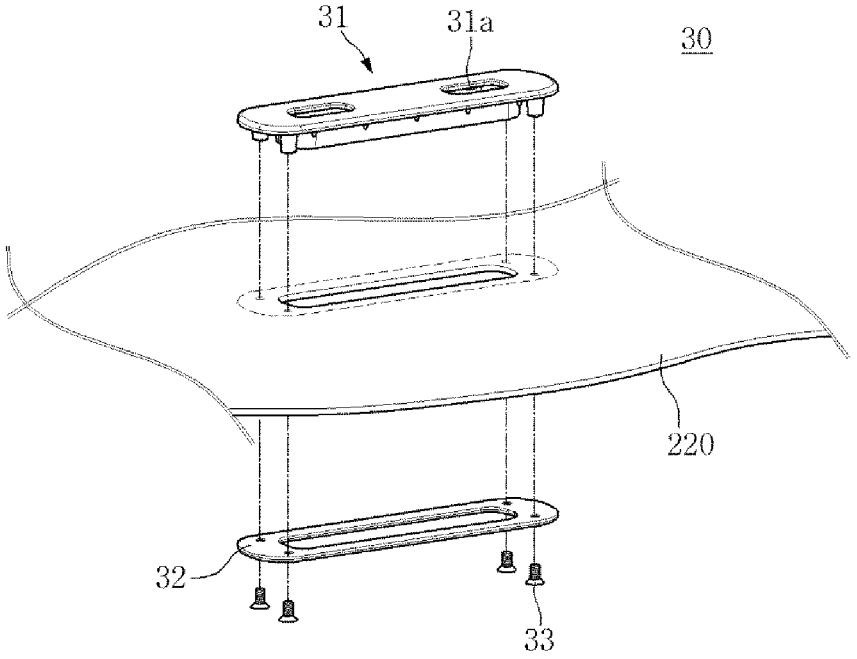
FIG. 2 shows an exploded perspective view of the body-side sub-assembly of the conventional lock assembly to be attached to a handbag, wherein the body-side sub-assembly is to be secured to the bag body.
Figure 3:
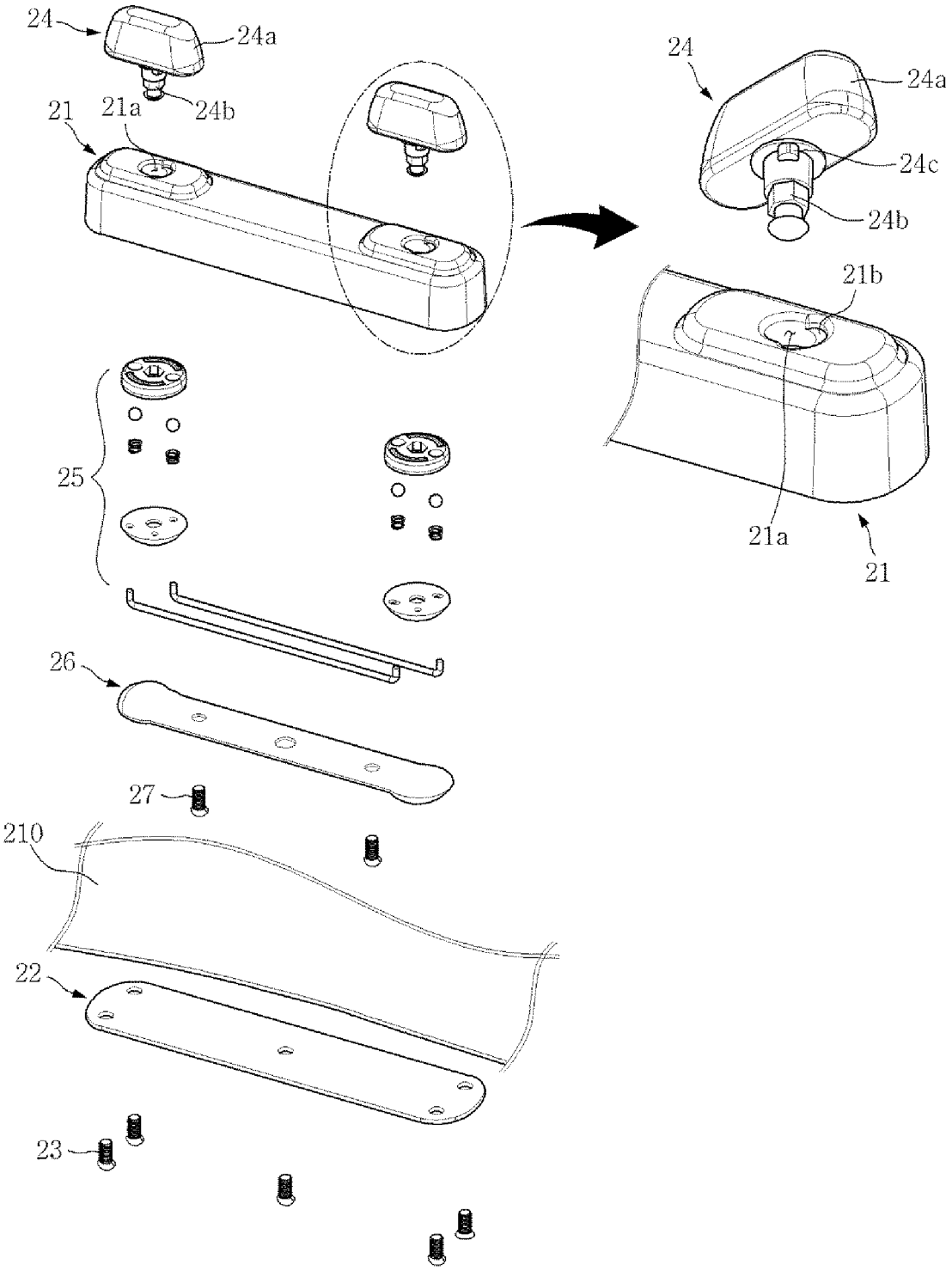
FIG. 3 shows an exploded perspective view of the flap-side sub-assembly of the conventional lock assembly to be attached to a handbag, wherein the flap-side sub-assembly is to be secured to the bag flap.
Figure 4:
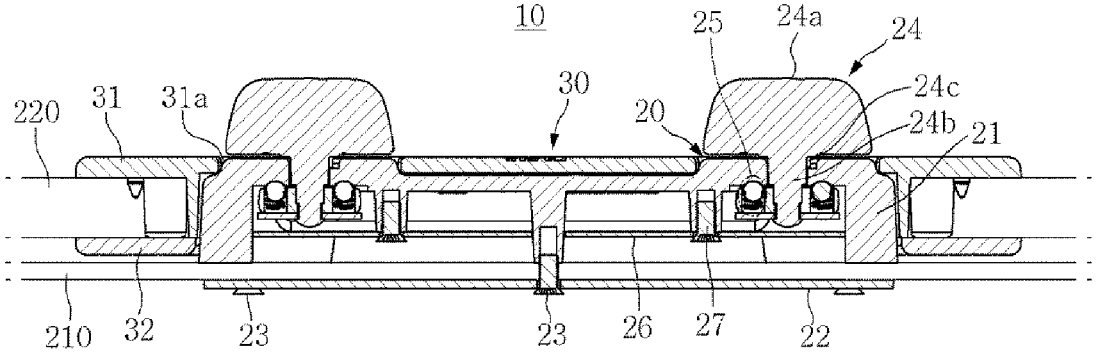
FIG. 4 shows a cross-sectional view of the conventional lock assembly wherein the lock assembly is in an unlocking state.

| Reference numerals | |
|---|---|
| 10: conventional lock assembly for bag | |
| 20: body-side sub-assembly | |
| 21: base member | 21a: shaft-insertion hole |
| 21b: guide groove | 22: bag body fixture |
| 23: bag body fixing bolt | 24: rotation member |
| 24a: upper grip | 24b: lower shaft |
| 24c: rotation guide protrusion | |
| 25: rotation-force transfer mechanism | |
| 26: base member fixture | 27: base member fixing bolt |
| 30: flap-side sub-assembly | 31: front fixture |
| 31a: elongate hole | 32: rear fixture |
| 33: fixing bolt | |
| 100: present lock assembly for bag | |
| 110: body-side sub-assembly | 111: base member |
| 111a: shaft-insertion hole | 111b: recess |
| 112: bag body fixture | 113: bag body fixing bolt |
| 114: rotation member | 114a: upper grip |
| 114b: lower shaft | 114c: convex portion |
| 115: rotation-member coupler | 115a: first teeth |
| 116: spring | 117: belt |
| 117a: second teeth | 118: base member fixture |
| 119: base member fixing bolt | 120: flap-side sub-assembly |
| 121: front fixture | 121a: elongate hole |
| 122: rear fixture | 123: fixing bolt |
| 200: handbag | 210: bag body |
| 220: bag flap | |

DETAILED DESCRIPTION OF THE INVENTION

Examples of various embodiments are illustrated in the accompanying drawings and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims.

Example embodiments will be described in more detail with reference to the accompanying drawings. The present disclosure, however, may be embodied in various different forms, and should not be construed as being limited to only the illustrated embodiments herein. Rather, these embodiments are provided as examples so that this disclosure will be thorough and complete, and will fully convey the aspects and features of the present disclosure to those skilled in the art.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element or layer is referred to as being "connected to", or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, s, operations, elements, and/or components, but do not preclude the presence or addition of one or more other features, integers, s, operations, elements, components, and/or portions thereof. As used herein, the term "and/or" includes any and all combinations of one or more of the associated listed items. Expression such as "at least one of" when preceding a list of elements may modify the entire list of elements and may not modify the individual elements of the list.

Spatially relative terms, such as "beneath," "below," "lower," "under," "above," "upper," and the like, may be used herein for ease of explanation to describe one element or feature's relationship to another element s or feature s as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented for example, rotated 90 degrees or at other orientations, and the spatially relative descriptors used herein should be interpreted accordingly.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In the following description, numerous specific details are set forth in order to provide a thorough understanding of the present disclosure. The present disclosure may be practiced without some or all of these specific details. In other instances, well-known process structures and/or processes have not been described in detail in order not to unnecessarily obscure the present disclosure.

Hereinafter, embodiments of a lock assembly in accordance with the present disclosure will be described in details with reference to attached drawings.

Figure 5:
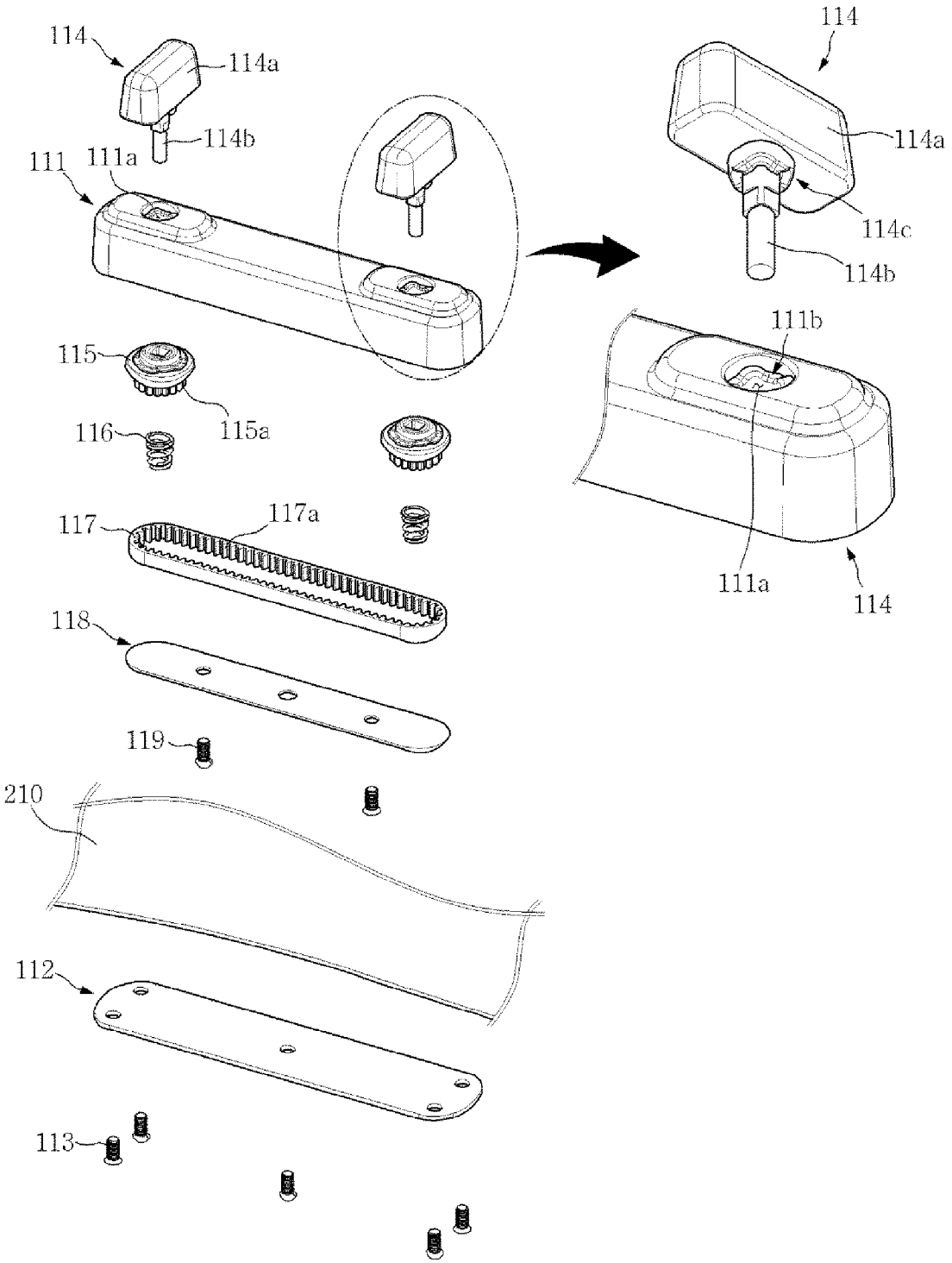
FIG. 5 shows an exploded perspective view of a body-side sub-assembly of the present lock assembly to be attached to a handbag, wherein the body-side sub-assembly is to be secured to a bag body.
Figure 6:
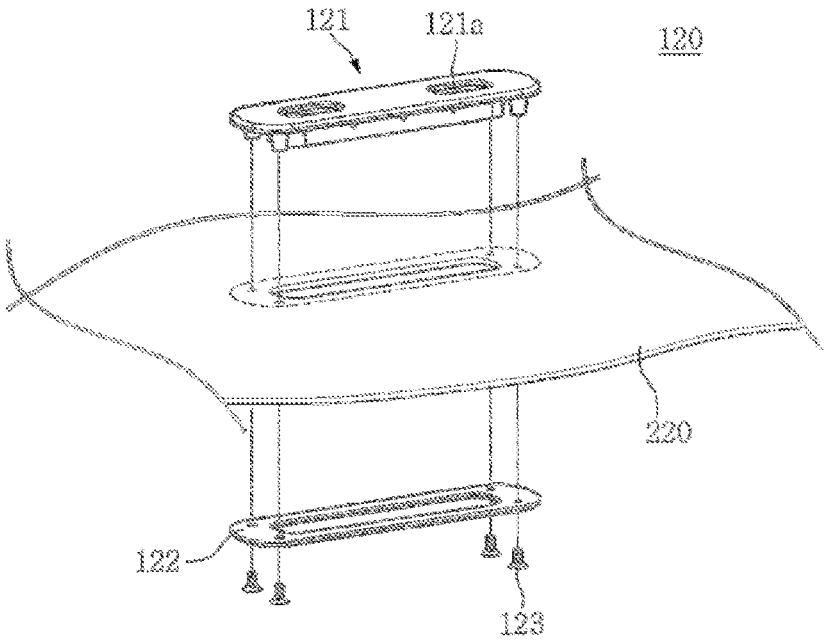
FIG. 6 shows an exploded perspective view of a flap-side sub-assembly of the present lock assembly to be attached to a handbag, wherein the flap-side sub-assembly is to be secured to a bag flap.

FIG. 5 shows an exploded perspective view of a body-side sub-assembly of the present lock assembly to be attached to a handbag, wherein the body-side sub-assembly is to be secured to a bag body. FIG. 6 shows an exploded perspective view of a flap-side sub-assembly of the present lock assembly to be attached to a handbag, wherein the flap-side sub-assembly is to be secured to a bag flap.

The lock assembly 100 for a bag in accordance with one embodiment of the present disclosure may be attached, for example, a handbag including a bag body 210 to receive therein articles, and a bag flap 220 configured to open or close an opening of the body 210. The present disclosure is not limited thereto.

The lock assembly 100 for a bag in accordance with one embodiment of the present disclosure may include a body-side sub-assembly 110 secured to the bag body 210, and a flap-side sub-assembly 120 secured to the bag flap 220. The flap-side sub-assembly 120 may have two elongate holes 121*a* formed at opposing sides thereof. The two elongate holes 121 may pass through the bag flap 220. In an operation, for a lock mode, the body-side sub-assembly 110 is coupled to the flap-side sub-assembly 120 and is rotated to a locking position. Otherwise, for an unlock mode, the body-side sub-assembly 110 is rotated to an unlocking position and is separated from the flap-side sub-assembly 120.

As shown in FIG. 5, the body-side sub-assembly 110 may include a base member 111, a pair of rotation members 114, and a rotation-force transfer mechanism. The body-side sub-assembly 110 may be secured to the bag body 210 using a bag body fixture 112 and bag body fixing bolts 113.

The base member 111 may be secured to the bag body 210 using the bag body fixture 112 and bag body fixing bolts 113. Thus, the base member 111 may be closed, at an open rear side thereof, to form an inner space therein. On a front side of the base member 111, a pair of shaft-insertion holes 111*a* may be formed to correspond to the pair of elongate holes 121*a* of the flap-side sub-assembly 120 respectively. Each of the shaft-insertion holes 111*a* may have four recesses 111*b* arranged regularly along a rim of the hole. That is, the four recesses 111*b* are arranged by a 90° angular distance.

The pair of rotation members 114 each may include a horizontal bar-shaped upper grip 114*a* and a vertical bar-shaped lower shaft 114*b*. The horizontal bar-shaped upper grip 114*a* and the vertical bar-shaped lower shaft 114*b* may be monolithic. A combination of the horizontal bar-shaped upper grip 114*a* and the vertical bar-shaped lower shaft 114*b* is rotated to lock or unlock the bag.

The upper grip 114*a* may pass away the corresponding elongate hole 121*a*, and, thereafter, may be kept to be orientated in an orthogonal direction to the elongate hole 121*a* to keep the locking state of the bag. Otherwise, the upper grip 114*a* may be orientated in a parallel direction to the corresponding elongate hole 121*a* and, thereafter, may pass away the corresponding elongate hole to be separated from the elongate hole 121*a*, to unlock the bag. The upper grip 114*a* may be disposed on the front side of the base member 111.

The upper grip 114*a* may have a convex portion 114*c* formed at a bottom thereof. Each convex portion 114*c* may be engaged with each recess 111*b*. Thus, four convex portions 114*c* may be arranged regularly. That is, the four convex portions 114*c* are arranged by a 90° angular distance. Thus, whenever the rotation member 114 rotates by 90° in any direction, each convex portion 114*c* is engaged with each recess 111*b*, and, therefore, the rotation member 114 stops. This may lead to no clearance or deviation during the rotation thereof. The rotation member may be precisely aligned. Further, the rotation member may be securely kept to be in the locked or unlocked state of the bag.

The lower shaft 114*b* may extend downwards vertically from the corresponding upper grip 114*a*. The lower shaft 114*b* is rotatably inserted into the shaft-insertion hole 111*a* via a rotation of the upper grip 114*a*. That is, the lower shaft 114*b* is rotatably engaged with the base member 111.

The rotation-force transfer mechanism may include a pair of rotation-member couplers 115, a pair of springs 116, and a single belt 117. Thus, when one rotation member of the pair of rotation members 114 is rotated, the rotation-force transfer mechanism may transfer the rotation force from one rotation member 114 to the other rotation member 114. In this way, the pair of rotation members 114 may be rotated via a rotation of only a single rotation member 114.

Each coupler of the pair of rotation-member couplers 115 may be coupled to the lower shaft 114*b* passing away the shaft-insertion hole 111*a*. When being in a coupled state, each rotation-member coupler 115 may rotate together with the rotation member 114 via the rotation force of the member within the inner space of the base member 111. Each rotation-member coupler 115 may have an inner space defined therein to receive the corresponding spring 116.

The spring 116 may be disposed in the inner space of the corresponding rotation-member coupler 115. Thus, the spring 116 may compress when the rotation member 114 rotate, thereby to facilitate disengagement of the convex portion 114*a* from the recess 111*b*. Further, the spring 116 may restore when the rotation of the rotation member 114 terminates, thereby to retain the convex portion 114*a* into the recess 111*b*.

The single belt 117 may be coupled to the two rotation-member couplers 115. That is, the two rotation-member couplers 115 are coupled to both inner ends of the single belt 117 respectively. In this way, via the single belt 117, the separate two rotation members 114 may be operatively coupled to each other. In this regard, the rotation direction of the single belt 117 is not limited but includes any direction. Thus, the rotation force may be transferred between the separate two rotation members 114 in any direction. To this end, the rotation-member coupler 115 may have first teeth 115*a* formed at an outer periphery thereof. The belt 117 may have second teeth 117*a* formed at an inner periphery thereof. In an operation, the first teeth 115*a* may mesh with the second teeth 117*a* to transfer the rotation force from one rotation member 114 to the other rotation member 114.

The base member fixture 118 closes the open bottom of the base member 11, and the body-side sub-assembly 110 may be secured to the bag body 210 using the base member fixing bolts 119.

As shown in FIG. 6, the flap-side sub-assembly 120 may include a front fixture 121, a rear fixture 122, and fixing bolts 123. The flap-side sub-assembly 120 may be secured to the bag flap 220 using the front fixture 121, rear fixture 122, and fixing bolts 123.

The front fixture 121 may have the adjacent two elongate holes 121*a* formed therein, where the two elongate holes 121*a* pass through the bag flap 220. The front fixture 121 may be secured to a front side of the bag flap 220. The rear fixture 122 may be secured to a rear side of the bag flap 220 to correspond to the front fixture 121. The fixing bolt 123 may secure the front fixture 121 and rear fixture 122 to each other, and, thus, fasten the front fixture 121 and rear fixture 122 to the bag flap 220.

Operations of the lock assembly 100 for a bag in accordance with one embodiment of the present disclosure will be described in details below with reference to the attached drawings.

Figure 7A:
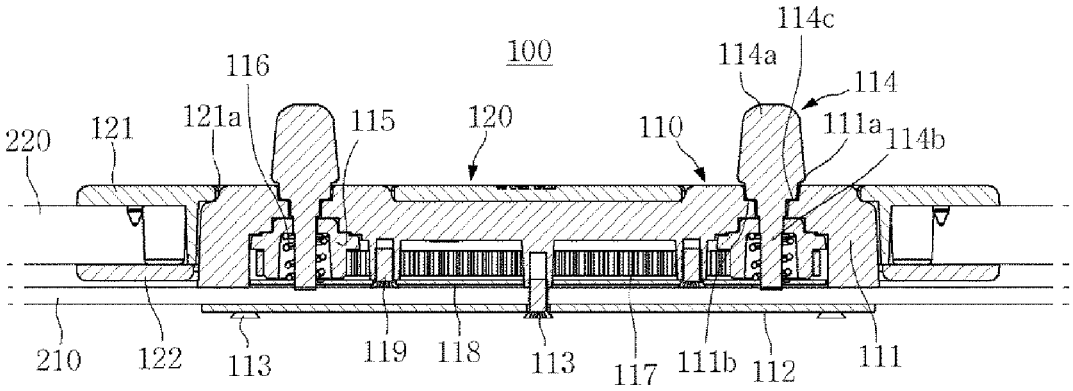
FIG. 7A to FIG. 7C show respectively cross-sectional views for illustrating operations of the present lock assembly.
Figure 7B:
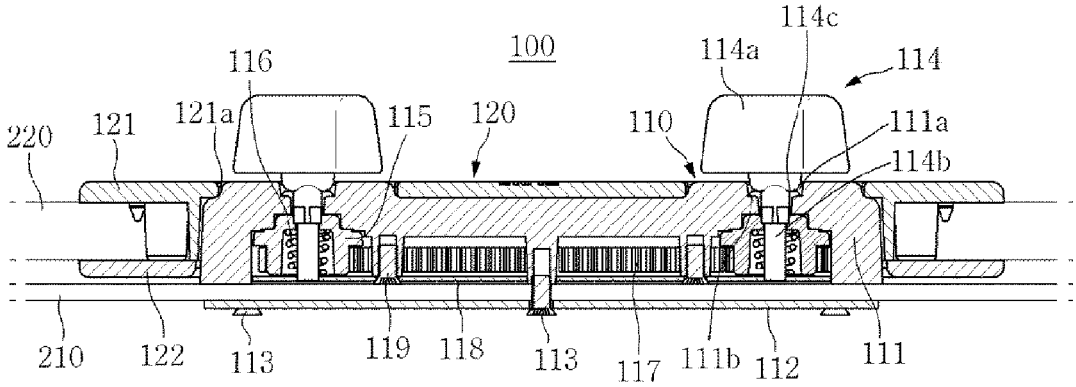
Figure 7C:
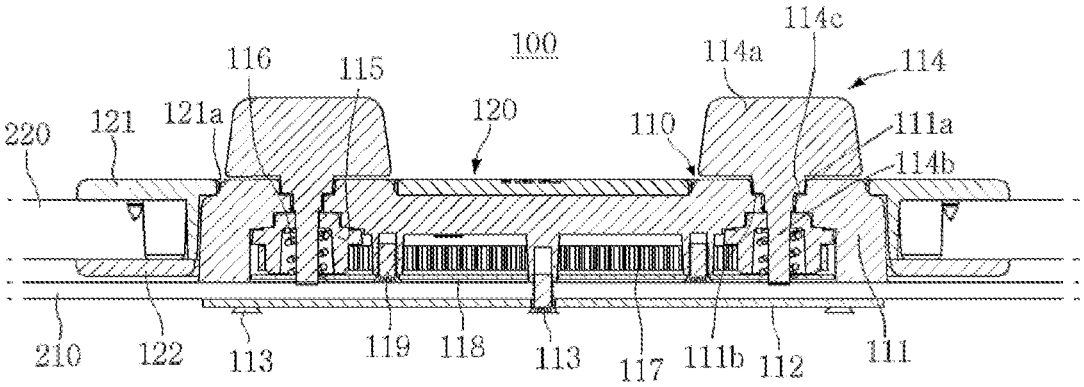

FIG. 7A to FIG. 7C show respectively cross-sectional views for illustrating operations of the present lock assembly.

FIG. 7A shows a combination of the body-side sub-assembly 110 and flap-side sub-assembly 120 in the lock assembly 100 for a bag in accordance with one embodiment of the present disclosure. In this connection, as shown in FIG. 7A, the bag flap 220 is engaged from the bag body 210.

In order to achieve the engaged state, the upper grip 114*a* of the body-side sub-assembly 110 may be rotated to be oriented in a parallel direction with an extension direction of the corresponding elongate hole 121*a*. Thereafter, the upper grip 114*a* may pass away the elongate hole 121*a*.

After the upper grip 114*a* has passed away the elongate hole 121*a*, the upper grip 114*a* is rotated by 90° in any direction, namely, in a clockwise or counter-clockwise direction. Then, the belt 117 may transfer the rotation force from the rotated upper grip 114*a* to the other upper grip 114*a*. In this way, the both upper grips 114*a* may be oriented in a orthogonal direction with an extension direction of the corresponding elongate hole 121*a*. This may result in a locked state of the bag. In this connection, the spring 116 may act to firmly retain each convex portion 114*c* in each recess 111*b*.

Based on a desired state, namely, a locked or unlocked state of the bag, any one of the two upper grips 114*a* may be rotated by 90° without a limitation related to the rotation direction, that is, in any direction, namely, in a clockwise or counter-clockwise direction. In this connection, the rotation-force transfer mechanism may transfer the rotation force from one rotation member to the other rotation member. In order to achieve a unlocked state of the bag, the upper grip 114*a* of the body-side sub-assembly 110 may be rotated to be oriented in a parallel direction with an extension direction of the corresponding elongate hole 121*a*. Then, the upper grip 114*a* passes away the corresponding elongate hole 121*a*. In this way, the bag flap 220 may be detached, at its free end, from the bag body 210.

In this connection, as shown in FIG. 7B, each convex portion 114*a* may be disengaged from each recess 111*b*, and, then, the upper grip 114*a* may move upwards. At the same time, the spring 116 may be compressed to facilitate the disengagement of each convex portion 114*a* from each recess 111*b*. At the same time, the belt 117 may transfer the rotation force from the rotated upper grip to the other upper grip 114*a* to rotate the other upper grip 114*a*.

When the rotation of the upper grip 114*a* of the rotation member 114 terminates, the convex portion 114*a* may be engaged with the recess 111*b* as shown in FIG. 7C. At the same time, the spring 116 may restore to retain the convex portion 114*a* into the recess 111*b*. In this way, the bag flap 220 may be detached, at its free end thereof, from the bag body 210.

The present rotation-force transfer mechanism may include the pair of rotation-member couplers 115, the pair of the springs 116, and the single belt 117. That is, the present rotation-force transfer mechanism may be advantageous over the rotation-force transfer mechanism of the above-described conventional lock assembly where, when the rotation member 24 rotates by 90° in a specific direction such that the rotation guide protrusion 24*c* moves along the guide groove 21*b*, the linker transfers the rotation force from one rotation member 24 to the other rotation member 24. Specifically, the present rotation-force transfer mechanism may have smaller number of components than that of the conventional rotation-force transfer mechanism. This may lead to easiness to assembly the present rotation-force transfer mechanism. Further, the present rotation-force transfer mechanism may not limit the rotation direction of the rotation member 140 to the specific direction, which is the case for the conventional rotation-force transfer mechanism. This may lead to convenience for the user to operate the lock assembly. Furthermore, using the present rotation-force transfer mechanism together with the configuration of the four corresponding recesses and convex portions, the rotation member may be precisely aligned. Further, the rotation member may be securely kept to be in the locked or unlocked state of the bag.

While the present disclosure has been described with reference to the handbag, the present disclosure is not limited thereto. The present disclosure may be applied to any bag having a bag body having a storage space formed therein, and a bag flap configured to open or close an opening of the body.

The above description is not to be taken in a limiting sense, but is made merely for the purpose of describing the general principles of exemplary embodiments, and many additional embodiments of this disclosure are possible. It is understood that no limitation of the scope of the disclosure is thereby intended. The scope of the disclosure should be determined with reference to the Claims. Reference throughout this specification to "one embodiment," "an embodiment," or similar language means that a particular feature, structure, or characteristic that is described in connection with the embodiment is included in at least one embodiment of the present disclosure. Thus, appearances of the phrases "in one embodiment," "in an embodiment," and similar language throughout this specification may, but do not necessarily, all refer to the same embodiment.

What is claimed is:

1. A lock assembly for a bag, wherein the bag has a bag body having an article receiving space formed therein, and a bag flap configured to open or close an opening of the body, the assembly comprising:

a body-side sub-assembly secured to the bag body; and a flap-side sub-assembly secured to the bag flap, wherein the flap-side sub-assembly has two elongate holes formed therein, the two elongate holes passing through the bag flap, wherein the body-side sub-assembly comprises:

a base member having a rear portion secured to the bag body, the base member having an inner space formed therein, the base member having two shaft-insertion holes formed in a front portion thereof, the shaft-insertion holes corresponding, in a position, to the two elongate holes respectively;

a pair of rotation members, each rotation member including an upper grip and a lower shaft extending from the upper grip, wherein the upper grip is rotatably disposed on the front portion of the base member, wherein the upper grip is configured to rotate to be oriented to be parallel or orthogonal to an extension direction of the corresponding elongate hole, wherein the upper grip is configured to pass away the corresponding elongate hole, wherein the lower shaft is rotatably inserted into the corresponding shaft-insertion hole; and a rotation-force transfer mechanism configured to transfer a rotation force between the pair of rotation members, the rotation-force transfer mechanism including a pair of rotation-member couplers, and a belt, wherein the pair of rotation-member couplers and the belt are received in the inner space of the base member, wherein each rotation-member coupler is operatively coupled to each lower shaft such that each rotation-member coupler rotates together with each rotation member, wherein the belt is operatively coupled to the two rotation-member coupler to allow the two rotation-member couplers to co-rotate in any direction, wherein each of the shaft-insertion holes has four recesses arranged regularly along a rim of the hole by a 90° angular distance, wherein each rotation member has four convex portions to correspond, in a position, to the four recesses respectively, wherein each convex portion is engaged or disengaged with each recess during the rotation of the rotation member.

2. The assembly of claim 1, wherein each rotation-member coupler has first teeth formed at an outer periphery thereof, and the belt has second teeth formed at an inner periphery thereof, wherein the first teeth mesh with the second teeth to transfer the rotation force between the two rotation members.

3. The assembly of claim 2, wherein each spring is provided beneath each rotation-member coupler to keep the engagement or disengagement between each recess and each convex portion.

* * * * *